US011598135B2

(12) United States Patent
Keßler et al.

(10) Patent No.: US 11,598,135 B2
(45) Date of Patent: Mar. 7, 2023

(54) DRIVE DEVICE FOR MOVING A CLOSURE ELEMENT OF A MOTOR VEHICLE

(71) Applicant: STABILUS GMBH, Koblenz (DE)

(72) Inventors: Jonathan Keßler, Großholbach (DE); Martin Neitzert, Urbach (DE); Christoph Ulrich, Kratzenburg (DE)

(73) Assignee: STABILUS GMBH, Koblenz (DE)

( * ) Notice: Subject to any disclaimer, the term of this patent is extended or adjusted under 35 U.S.C. 154(b) by 30 days.

(21) Appl. No.: 17/398,128

(22) Filed: Aug. 10, 2021

(65) Prior Publication Data

US 2022/0049533 A1 Feb. 17, 2022

(30) Foreign Application Priority Data

Aug. 11, 2020 (DE) ..... 102020121145.7
Dec. 7, 2020 (DE) ..... 102020132508.8

(51) Int. Cl.
*E05F 1/08* (2006.01)
*E05F 1/10* (2006.01)
*E05F 15/622* (2015.01)

(52) U.S. Cl.
CPC ..... *E05F 1/105* (2013.01); *E05F 15/622* (2015.01); *E05Y 2201/434* (2013.01);
(Continued)

(58) Field of Classification Search
CPC ... E05F 1/105; E05F 3/108; E05F 3/02; E05F 3/04; E05F 15/622; E05Y 2201/46; E05Y 2201/462; E05Y 2201/41; E05Y 2201/434; E05Y 2201/474; E05Y 2201/412; E05Y 2201/702; E05Y 2900/132;
(Continued)

(56) References Cited

U.S. PATENT DOCUMENTS

2009/0199482 A1* 8/2009 Arenz ..... E05F 15/622 267/141
2012/0137803 A1* 6/2012 Bochen ..... F16H 25/2015 74/89.32
(Continued)

FOREIGN PATENT DOCUMENTS

DE 10 2012 221 645 A1 6/2013
DE 10 2012 100 220 A1 7/2013
(Continued)

*Primary Examiner* — Chuck Y Mah
(74) *Attorney, Agent, or Firm* — Schmeiser, Olsen & Watts, LLP

(57) ABSTRACT

Provided is a drive device for the movement of a closure element of a motor vehicle relative to a body of the motor vehicle including an outer tube with a longitudinal axis for coupling to the body, an inner element arranged in the outer tube for coupling to the closure element, a helical compression spring arranged between the inner element and the outer tube, and an internal guide element arranged between the inner element and the helical compression spring and axially fixed to the inner element for the internal guidance of an internal guide end section of the helical compression spring. The inner element is extendable along the longitudinal axis from the outer tube. The helical compression spring is compressed against a spring tension of the helical compression spring when the inner element is pulled out of the outer tube.

13 Claims, 2 Drawing Sheets

(52) U.S. Cl.
CPC ... *E05Y 2201/474* (2013.01); *E05Y 2201/702* (2013.01); *E05Y 2900/531* (2013.01)

(58) Field of Classification Search
CPC . E05Y 2900/531; Y10T 16/593; Y10T 16/56; Y10T 16/568; Y10T 16/64; Y10T 16/2799; Y10T 16/287; Y10T 16/281
See application file for complete search history.

(56) References Cited

U.S. PATENT DOCUMENTS

| | | | | |
|---|---|---|---|---|
| 2017/0044814 | A1* | 2/2017 | Scheuring | B60J 5/106 |
| 2018/0283075 | A1* | 10/2018 | Inagaki | F16H 25/20 |
| 2020/0002992 | A1* | 1/2020 | Sekine | F16H 25/20 |
| 2020/0232267 | A1* | 7/2020 | Rehm | E05F 1/1058 |
| 2021/0040785 | A1* | 2/2021 | Wittelsbürger | E05F 15/622 |
| 2021/0230923 | A1* | 7/2021 | Yokozawa | H02P 6/06 |
| 2021/0270075 | A1* | 9/2021 | Sakiyama | F16H 25/20 |
| 2022/0136294 | A1* | 5/2022 | Scheuring | B60J 5/10 16/85 |

FOREIGN PATENT DOCUMENTS

| | | | | |
|---|---|---|---|---|
| DE | 10 2017 117 993 | A1 | 2/2019 | |
| DE | 10 2018 121 033 | A1 | 3/2020 | |
| EP | 2 199 513 | A1 | 6/2010 | |
| EP | 3686461 | A1 * | 7/2020 | E05F 1/1058 |
| WO | WO-2010069785 | A1 * | 6/2010 | E05F 15/622 |
| WO | WO-2013104622 | A1 * | 7/2013 | B60J 5/10 |
| WO | 2019/007583 | A1 | 1/2019 | |

* cited by examiner

Figure 1:
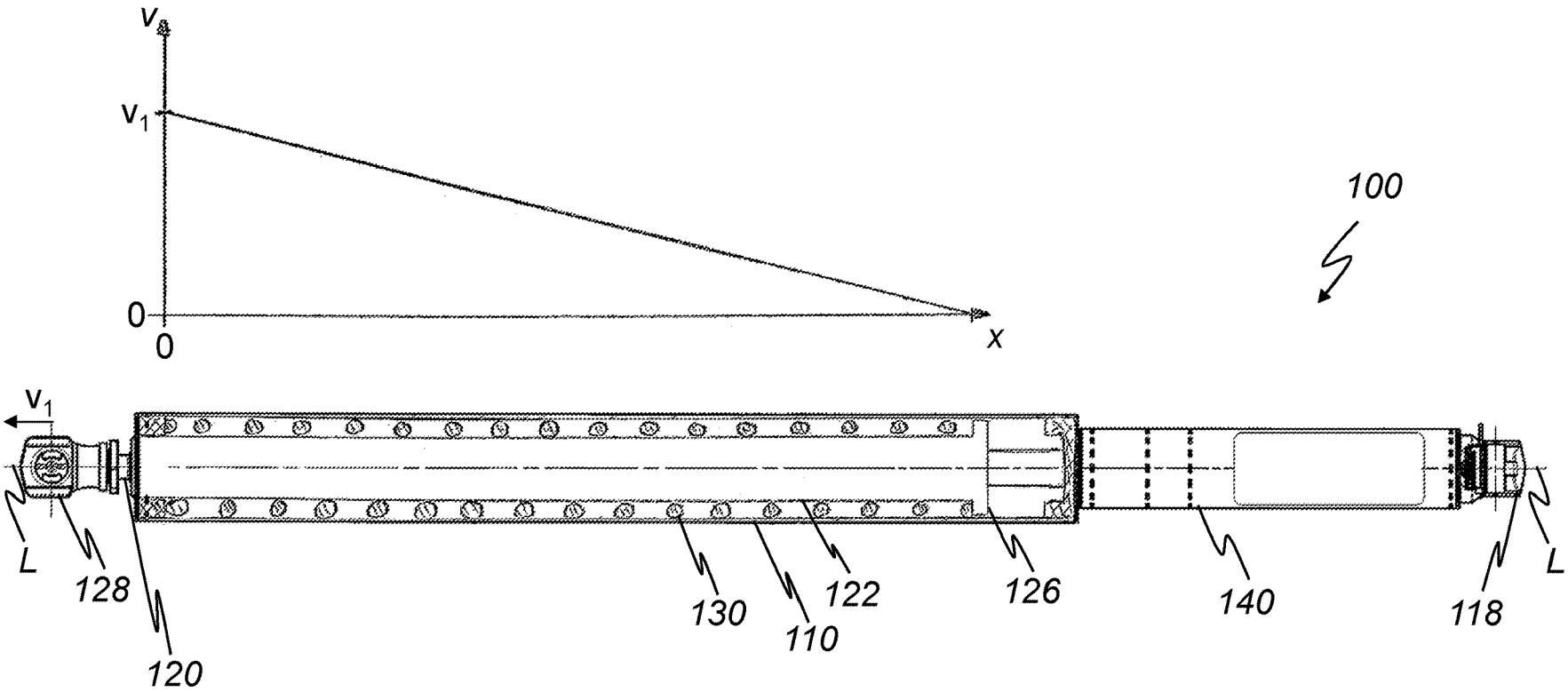

FIG.1 (State of the art)

DRIVE DEVICE FOR MOVING A CLOSURE ELEMENT OF A MOTOR VEHICLE

CROSS-REFERENCE TO RELATED APPLICATIONS

This application claims priority to DE 102020121145.7, having a filing date of Aug. 11, 2020 and DE 102020132508.8, having a filing date of Dec. 7, 2020, the entire contents both of which are hereby incorporated by reference.

FIELD OF TECHNOLOGY

The following relates to a drive device for moving a closure element of a motor vehicle.

BACKGROUND

Spindle drives according to the paradoxical design (tension-loaded spindle drive equipped with a helical compression spring) tend to generate noise in the guide system of the spring. This effect is amplified when using springs with higher spring forces. In addition, this effect is dependent on wear.

The paradoxical design of a spindle drive, which is known, for example, from publications DE 10 2017 117 993 A1, DE 10 2018 121 033 A1, DE 10 2012 100 220 A1, EP 2 199 513 A1, and WO 2019/007583 A1, is characterized as follows:

The spindle drive is subjected to tensile load. The design includes the use of a helical compression spring, in which the direction of action of the spring forces is reversed using two coupling elements. The outer coupling element is referred to as the spring housing tube or outer tube and has as a termination a guide bush, which is directly connected to the spring housing tube. The guide bush serves to conduct the forces of the spring to the spring housing tube.

The inner coupling element is referred to as the spring guide or internal guide element and is completely passed through the helical compression spring and indirectly transmits the spring forces to a ball socket for connecting the spindle drive to a motor vehicle body.

Depending on the design of the spindle drive, the helical compression spring is guided completely and exclusively by the internal spring guide or by the internal spring guide and the spring housing tube (DE 10 2012 221 645 A1).

Compared to the system of a spindle drive with tension spring (which, like the spindle drive, is subjected to tensile load), paradoxical spindle drives can be produced with a smaller outer diameter and lower weight. However, a larger overall length of the spindle drive must be accepted for this.

Test results have shown that the paradoxical system is susceptible to the generation of noise in the spring's guidance system. With increasing spring forces, this effect is amplified.

Even with the help of customary optimization attempts (different lubricating greases or different surface structure of the guide partners), the noise cannot be eliminated.

SUMMARY

An aspect relates to a cost-effective drive device for moving a closure element of a motor vehicle, which works quieter and with less wear than known spindle drives according to the paradoxical design.

Embodiments of the invention relate to a drive device for moving a closure element, in particular a door or a luggage compartment flap, of a motor vehicle, in particular a passenger car, relative to a body of the motor vehicle.

The drive device comprises an outer tube with a longitudinal axis for coupling to the body or the closure element and an inner element at least partially arranged in the outer tube for coupling to the other element of body and closure element. The coupling can be carried out, for example, via a ball socket attached to each of the outer tube and the inner element coupled to a ball pin complementary to the ball socket on the body and the closure element.

The outer tube and/or the inner element may be substantially cylindrical in shape. The inner element can be hollow or filled. The inner element is arranged coaxially to the longitudinal axis.

The drive device comprises a helical compression spring arranged radially to the longitudinal axis between the inner element and the outer tube and an internal guide element arranged radially to the longitudinal axis between the inner element and the helical compression spring and axially fixed to the inner element for the internal guidance of an internal guide end section of the helical compression spring along the longitudinal axis.

Two components are "axially fixed" to each other if the components are at least secured against an axial displacement against each other along the longitudinal axis. Regardless of this, the components may be rotatable against each other around the longitudinal axis.

The inner element is telescopically extendable out of the outer tube along the longitudinal axis. By this displacement of the inner element relative to the outer tube, the drive device can drive a movement of the closure element relative to the body.

The helical compression spring is clamped between the inner element and the outer tube in such a way that the helical compression spring is compressed against a spring tension of the helical compression spring when the inner element is pulled out of the outer tube.

If the drive device is coupled to the body and the closure element in such a way that the inner element is pulled out of the outer tube during a closing movement of the closure element, the spring tension of the helical compression spring thus drives an opening movement of the closure element or supports it, for example against a weight of the closure element.

The drive device may comprise an electromechanical drive unit for displacing the inner element relative to the outer tube along the longitudinal axis. The drive unit may include, in particular, an electric motor and a threaded spindle driven thereby. In this case, the drive device is a spindle drive according to the paradoxical design described above.

The drive device comprises an external guide element arranged radially to the longitudinal axis between the outer tube and the helical compression spring and axially fixed to the outer tube for the external guidance along the longitudinal axis of an external guide end section of the helical compression spring opposite the internal guide end section along the longitudinal axis.

The terms "end" and "end section" refer to the ends of a component along the longitudinal axis.

The external guide end section of the helical compression spring is supported along the longitudinal axis on the outer tube, in particular via the external guide element. The internal guide end section of the helical compression spring is supported along the longitudinal axis on the inner element, in particular via the internal guide element.

If the end sections of the helical compression spring are supported by the guide elements on the outer tube and/or the inner element, the advantage results from this that the guide elements can be fixed axially to the outer tube and/or the inner element by the spring force of the helical compression spring.

The external guide end section of the helical compression spring is guided only by the external guide element in at least one state of motion of the inner element relative to the outer tube, and the internal guide end section of the helical compression spring is guided only by the internal guide element in said at least one state of motion. In particular, the external guide end section is not guided by the internal guide element and the internal guide end section is not guided by the external guide element in said at least one state of motion.

Since the external guide end section of the helical compression spring is supported by the external guide element, when the inner element moves compared to the outer tube, the relative speed of the helical compression spring relative to the external guide element increases from the external guide end section to the internal guide end section of the helical compression spring. The lowest relative speed between the helical compression spring and the external guide element is therefore at the external guide end section of the helical compression spring.

Accordingly, when the inner element moves compared to the outer tube, the relative speed of the helical compression spring relative to the internal guide element increases from the internal guide end section to the external guide end section of the helical compression spring, because the internal guide end section is supported by the internal guide element. The lowest relative speed between the helical compression spring and the internal guide element is therefore at the internal guide end section of the helical compression spring.

The fact that the external guide end section of the helical compression spring is guided only by the external guide element, and the internal guide end section of the helical compression spring is guided only by the internal guide element, achieves a lower relative speed between the end sections of the helical compression spring and the guide elements than if both end sections were guided by the external guide element and/or both end sections by the internal guide element.

The reduced relative speed between the end sections of the helical compression spring and the guide elements leads to a reduced friction power and thus to a reduced noise development and a reduced wear compared to previously known drive systems.

Since the transverse force transferred from the helical compression spring to the guide elements is proportional to an axial force acting on the helical compression spring, the reduced friction power according to embodiments of the invention is particularly advantageous for drive devices that have to apply high axial forces, for example to drive a heavy tailgate of a luxury car.

The reduced friction power of the drive device can also have the effect that lubrication of the contact surfaces of the helical compression spring and guide elements with grease or oil can be reduced or even completely dispensed with by appropriate material selection and design of the guide elements.

As a result, a leakage of oil or grease from the drive device is less likely or even completely excluded. Thus, a risk of contamination for an environment or a user of the drive device is minimized.

In contrast to the state of the art, the elements around the helical compression spring (external guide element and outer tube) fulfil their functions separately from each other. Customary in the conventional art is either a plastic sleeve, which fulfills both guide tasks for the helical compression spring and support tasks for the drive device, or a steel tube, which fulfills either only support tasks or both guiding and support tasks.

Due to the division according to embodiments of the invention into outer tube and external guide element, the outer tube and the external guide element can be optimized independently of each other for different tasks. For example, the outer tube can be designed with a high mechanical stability for the support tasks. The external guide element can be designed with a low coefficient of friction against the helical compression spring for the guiding tasks.

The division into outer tube and external guide element is particularly advantageous for drive devices that have to apply a high force, since both sufficient mechanical stability and a sufficiently low coefficient of friction cannot be achieved with a single material at a reasonable cost.

However, an additional component causes additional costs, e.g. for parts production, injection molding tool, storage, and logistics. Another difficulty with an additional component when using the drive device in a motor vehicle is an additional risk of components rattling against each other, for example while driving over cobblestones or a rough road, as new points of contact between the components are created.

The external guide end section of the helical compression spring is guided only by the external guide element in any state of motion of the inner element relative to the outer tube. In particular, the external guide end section is not guided by the internal guide element in any state of motion.

The internal guide end section of the helical compression spring is guided only by the internal guide element in any state of motion of the inner element relative to the outer tube. In particular, the internal guide end section is not guided by the external guide element in any state of motion.

A guide element length of the external guide element and/or the internal guide element along the longitudinal axis is from 30% to 80% each, from 50% to 70%, or 50% or 60%, of a spring length of the helical compression spring along the longitudinal axis in a state of the inner element retracted maximally in the outer tube along the longitudinal axis.

In a state of the inner element maximally retracted along the longitudinal axis in the outer tube, a section length of the external guide end section and/or the internal guide end section of the helical compression spring along the longitudinal axis is from 30% to 70%, from 40% to 60%, or 50%, of a spring length of the helical compression spring along the longitudinal axis.

In the maximally retracted state of the inner element, the helical compression spring experiences a lower pressure load along the longitudinal axis than in states of the inner element extended further out of the outer tube. In particular, the helical compression spring can be essentially free of tensile or compressive loads along the longitudinal axis in the maximally retracted state of the inner element, so that the length of the helical compression spring corresponds in this state to a rest length of the helical compression spring.

Tests have shown that the above-mentioned values of the guide element length and the section length lead to a particularly strong reduction in the friction power between the helical compression spring and the guide elements.

The two guide elements are designed in such a way that the majority of the helical compression spring is guided on one side only (either inside or outside) in the maximally retracted state of the inner element.

It has been found that the highest load between the helical compression spring and the guide elements occurs at both spring ends. The one-sided spring guidance reduces the relative speed between the spring ends and the respective guide elements. This brings advantages for the excitation behavior of the spring, so that noise is reduced, and reduces the wear of the drive device.

Therefore, the two guide elements are designed in such a way that the spring ends are guided exclusively from one side (either inside or outside) even in the fully compressed state of the helical compression spring, when the inner element is maximally extended from the outer tube.

The inner element is distanced from the external guide end section of the helical compression spring radially to the longitudinal axis with an internal distance in the at least one state of motion, in any state of motion, of the inner element relative to the outer tube.

The outer tube is distanced from the internal guide end section of the helical compression spring radially to the longitudinal axis with an external distance in the at least one state of motion, in any state of motion, of the inner element relative to the outer tube.

The internal distance and/or external distance ensure that the end sections of the helical compression spring do not come into contact with the inner element and/or the outer tube, which could cause increased friction, increased wear, and increased noise.

The external guide end section of the helical compression spring has an external guide clearance to the external guide element radial to the longitudinal axis in the at least one state of motion, in any state of motion, of the inner element relative to the outer tube.

The inner diameter of the external guide element is chosen in such a way that there is a small external guide clearance even in the most unfavorable position, in particular when the helical compression spring is maximally compressed since the inner element is maximally extended from the outer tube, causing the outer diameter of the helical compression spring to expand slightly.

The internal guide end section of the helical compression spring has an internal guide clearance to the internal guide element radial to the longitudinal axis in the at least one state of motion, in any state of motion, of the inner element relative to the outer tube.

The outer diameter of the internal guide element is chosen in such a way that there is a small internal guide clearance even in the most unfavorable position, in particular if the helical compression spring is relaxed since the inner element is maximally inserted into the outer tube.

The internal guide clearance and/or external guide clearance reduces the friction power between the helical compression spring and the guide elements and reduces the risk of jamming of the helical compression spring with the guide elements.

The external guide element comprises a number of elastic compensating elements, ribs, on a side facing the outer tube for biasing against the outer tube and/or for tolerance compensation to the outer tube.

The internal guide element comprises a number of elastic compensating elements, ribs, on a side facing the inner element for biasing against the inner element and/or for tolerance compensation to the inner element.

The compensating elements allow a force-locking fixation of the guide elements, in particular against a displacement along the longitudinal axis, so that the guide elements remain at the position necessary for the desired guidance of the helical compression spring. In addition, the compensating elements reduce the required manufacturing accuracy of the guide elements, so that they can be produced faster and/or more cost-effectively.

The internal guide element is, for example, essentially cylindrically shaped and/or coaxially arranged to the longitudinal axis. The internal guide element can be hollow or filled.

The internal guide element comprises a support element, a protrusion radially away from the longitudinal axis, to support the internal guide end section of the helical compression spring along the longitudinal axis. Via the support element, the helical compression spring can support itself securely on the internal guide element without the need for an additional component.

The external guide element is, for example, essentially hollow cylindrical shaped and/or coaxially arranged to the longitudinal axis.

The external guide element comprises a centering element, a taper radially towards the longitudinal axis, to center the inner element in the external guide element. The centering element simplifies the assembly of the drive device. Furthermore, the centering element can serve as a support element to support the external guide end section of the helical compression spring along the longitudinal axis. Via the centering element, the helical compression spring can thus securely support itself on the external guide element without the need for an additional component.

The external guide element may comprise a number of elastic clamping elements, in particular a number of elastic arms directed towards the longitudinal axis, for clamping the inner element in the external guide element.

The external guide element and/or the internal guide element comprises at least one plastic, a low-friction and/or self-lubricating plastic, particularly a polyamide, a polyoxymethylene, a polycarbonate, or a polytetrafluoroethylene, or consists thereof. A guide element made of a plastic is inexpensive and lightweight and has good self-lubrication and dry-running properties.

The external guide element and/or the internal guide element has a low-excitation surface for the helical compression spring on a side facing the helical compression spring.

The outer tube and/or the inner element comprises a metal, a steel, or consists thereof. The outer tube or inner element can be produced cost-effectively with high mechanical stability of a metal.

The helical compression spring comprises a metal, a steel, more a spring steel, or consists thereof. The helical compression spring can be produced cost-effectively with high mechanical stability of a metal, the helical compression spring comprises a corrosion protection.

The helical compression spring comprises a plastic flocking to reduce frictional forces on the external guide element and/or the internal guide element. The plastic flocking also reduces wear and noise of the drive device.

The plastic flocking is particularly impregnated with a dry lubricant. The dry lubricant reduces the frictional force between the helical compression spring and the guide elements.

The external guide element and/or the internal guide element has a number of recesses, in particular perforations, radial to the longitudinal axis. The recesses can reduce the material requirement and the weight of the guide elements without significantly impairing the guidance effect. Furthermore, the recesses can serve as a reservoir for holding a lubricant to reduce friction between the helical compression spring and the external guide element and/or internal guide element.

The external guide element and/or the internal guide element is designed, for example, as a grid. A grid can provide sufficient mechanical stability and guiding effect with particularly low material requirement, but can only be produced with great effort, for example by injection molding.

BRIEF DESCRIPTION

Figure 2:
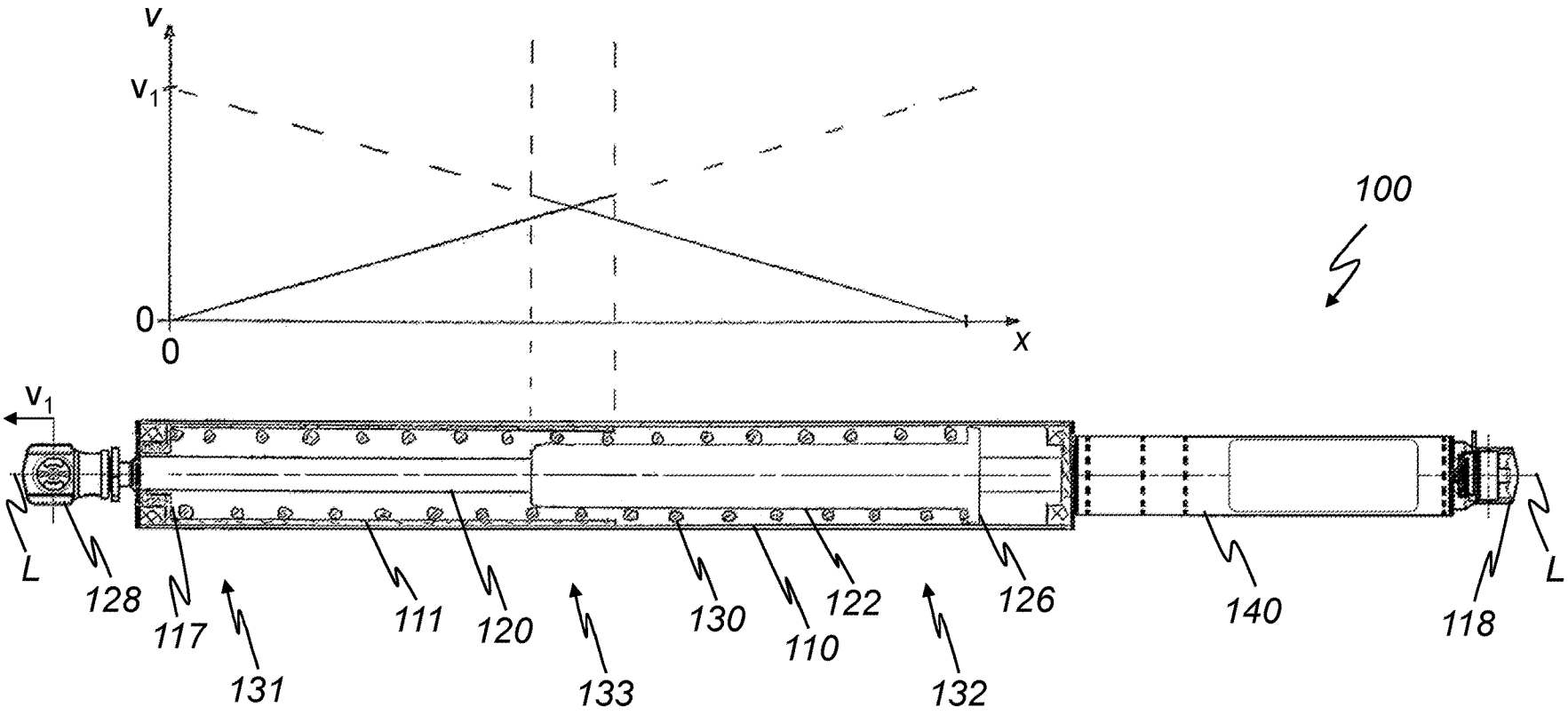

Some of the embodiments will be described in detail, with references to the following Figures, wherein like designations denote like members, wherein:

FIG. 1 shows a schematic longitudinal section along the longitudinal axis of a drive device from the conventional art; and FIG. 2 shows a schematic longitudinal section along the longitudinal axis of a drive device according to embodiments of the invention.

DETAILED DESCRIPTION

FIG. 1 shows a schematic longitudinal section along the longitudinal axis L of a drive device 100 from the conventional art.

The drive device 100 is designed to move a closure element of a motor vehicle relative to a body of the motor vehicle. The drive device 100 comprises an outer tube 110 with a longitudinal axis L for coupling to the body and an inner element 120 partially arranged in the outer tube 110 for coupling to the closure element, for example via an inner connection element 128, in particular a ball socket, attached to one end of the inner element 120.

The outer tube 110 and the inner element 120, for example, are each essentially hollow cylindrical shaped. The outer tube 110 and the inner element 120, for example, are arranged coaxially to the longitudinal axis L.

The drive device 100 comprises a helical compression spring 130 arranged radially to the longitudinal axis L between the inner element 120 and the outer tube 110, and an internal guide element 122 arranged radially to the longitudinal axis L between the inner element 120 and the helical compression spring 130 and axially fixed to the inner element 120 for internal guidance of the helical compression spring 130 along the longitudinal axis L.

The inner element 120 is telescopically extendable along the longitudinal axis L from the outer tube 110, so that the closure element coupled to the inner element 120 is movable relative to the body coupled to the outer tube 110.

The helical compression spring 130 is clamped between the internal guide element 122 and the outertube 120 in such a way that the helical compression spring 130 is compressed against a spring tension of the helical compression spring 130 when the inner element 120 is pulled out of the outer tube 110.

The internal guide element 122 comprises a support element 126, for example a protrusion radially away from the longitudinal axis L, to support the helical compression spring 130 along the longitudinal axis L.

The drive device 100 comprises, for example, an electromechanical drive unit 140 for displacement of the inner element 120 relative to the outer tube 110 along the longitudinal axis. The drive unit 140 may include, in particular, an electric motor and a threaded spindle driven thereby, so that the drive device 100 is a spindle drive according to the paradoxical design.

The drive unit 140 may, for example, be attached to the outer tube 110 opposite the inner coupling element 128 to the outer tube 110 and coupled to the body via an external coupling element 118, for example via another ball socket.

The graph above the drive device 100 shows a schematic course of a speed v of the helical compression spring 130 relative to the internal guide element 122 as a function of a distance x along the longitudinal axis L from the end of the helical compression spring 130 facing the inner coupling element 128, when the inner element 120 is pulled out of the outer tube with a pull-out speed $v_1$.

At the end of the helical compression spring 130 facing the coupling element 128 (at x=0), the speed v of the helical compression spring 130 corresponds to the pull-out speed $v_1$. With increasing distance x, the speed v decreases linearly to 0 at the other end of the helical compression spring 130, where the helical compression spring 130 is supported on the support element 126 of the internal guide element 122.

FIG. 2 shows a schematic longitudinal section along the longitudinal axis L of a drive device 100 according to embodiments of the invention.

In contrast to the state of the art shown in FIG. 1, the internal guide element 122 is designed only for the internal guidance of an internal guide end section 132 of the helical compression spring 130.

The drive device 100 shown in FIG. 2 comprises an external guide element 111 arranged radially to the longitudinal axis L between the outer tube 110 and the helical compression spring 130 and axially fixed to the outer tube 110 for external guidance along the longitudinal axis L of an external guide end section 131 of the compression spring 130 opposite the internal guide end section 132 along the longitudinal axis L.

The helical compression spring 130 is clamped between the internal guide element 122 and the external guide element 111 in such a way that the helical compression spring 130 is compressed against a spring tension of the helical compression spring 130 when the inner element 120 is pulled out of the outer tube 110.

The external guide end section 131 of the helical compression spring 130 is supported along the longitudinal axis L on the external guide element 111, in particular on a centering element 117 of the external guide element 111.

The internal guide end section 132 of the helical compression spring 130 is supported along the longitudinal axis L on the internal guide element 122, in particular on a support element 126 of the internal guide element 122.

The external guide end section 131 of the helical compression spring 130 is guided only by the external guide element 111 in at least one state of motion of the inner element 120 relative to the outer tube 110, and the internal guide end section 132 of the helical compression spring 130 is guided only by the internal guide element 122 in said at least one state of motion.

A guide element length of the external guide element 111 and the internal guide element 122 along the longitudinal axis L is, for example, each 50% to 60% of a spring length of the helical compression spring 130 along the longitudinal axis L in a state maximally retracted in the outer tube 110 along the longitudinal axis L as shown in FIG. 2.

As a result, the external guide end section 131, and the internal guide end section 132 of the helical compression spring 130 are each guided only on one side (either inside or outside). A middle section 133 of the helical compression spring 130 between the two end sections 131, 132 may be guided on both sides (outside and inside).

The graph above the drive device 100 shows a schematic course of a speed v of the helical compression spring 130 relative to the internal guide element 122 and external guide element 111 as a function of a distance x along the longitudinal axis L from the end of the helical compression spring 130 facing the inner coupling element 128, when the inner element 120 is pulled out of the outer tube 120 at a pull-out speed $v_1$.

The speed v is shown as a solid line in sections of the distance x in which the respective guide element 111, 122 guides the helical compression spring 130 and as a dashed line in areas where the respective guide element 111, 122 does not guide the helical compression spring 130.

Only the external guide element 111 guides the external guide end section 131 of the helical compression spring 130 facing the coupling element 128. The speed v is 0 at end of the helical compression spring 130 facing the coupling element 128 (at x=0), where the helical compression spring 130 is supported on the centering element 117 of the internal guide element 122, and increases linearly with increasing distance x to the middle section 133.

The internal guide end section 132 of the helical compression spring 130, which follows on the middle section 133 with increasing distance x, is not guided by the external guide element 111, but by the internal guide element 122. A further increase in the speed v (dashed line) relative to the external guide element 111 with further increasing distance x is therefore irrelevant for the function of the drive device 100.

The relevant speed v (solid line) of the internal guide end section 132 of the helical compression spring 130 relative to the internal guide element 122 decreases linearly as in FIG. 1 with increasing distance x to 0 at the end of the helical compression spring 130, where the helical compression spring 130 is supported on the support element 126 of the internal guide element 122.

The speed v (solid lines) of the helical compression spring 130 relative to the respective guiding guide element 111, 122 relevant for the function of the drive device 100 is thus much lower than the pull-out speed $v_1$ along the entire helical compression spring 130.

The lower speed v compared to the state of the art leads to reduced wear and noise.

Although the invention has been illustrated and described in greater detail with reference to the preferred exemplary embodiments, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

| List of reference signs | |
|---|---|
| 100 | Drive device |
| 110 | Outer tube |
| 111 | External guide element |
| 117 | Centering element |

-continued

| List of reference signs | |
|---|---|
| 118 | External connection element |
| 120 | Inner element |
| 122 | Internal guide element |
| 126 | Support element |
| 128 | Inner connection element |
| 130 | Helical compression spring |
| 131 | External guide end section |
| 132 | Internal guide end section |
| 133 | Middle section |
| 140 | Drive unit |
| L | Longitudinal axis |
| v | Speed |
| $v_1$ | Pull-out speed |
| x | Distance |

The invention claimed is:

1. A drive device for the movement of a closure element, of a motor vehicle relative to a body of the motor vehicle, comprising:

a. an outer tube with a longitudinal axis for coupling to the body or to the closure element;

b. an inner element arranged at least partially in the outer tube for coupling to the other element of body and closure element;

c. a helical compression spring arranged radially to the longitudinal axis between the inner element and the outer tube; and d. an internal guide element arranged radially to the longitudinal axis between the inner element and the helical compression spring and axially fixed to the inner element for internal guidance along the longitudinal axis of an internal guide end section of the helical compression spring;

e. wherein the inner element is telescopically extendable from the outer tube along the longitudinal axis; and wherein the helical compression spring is clamped between the inner element and the outer tube in such a way that the helical compression spring is compressed against a spring tension of the helical compression spring during an extension movement of the inner element from the outer tube, wherein f. an external guide element arranged radially to the longitudinal axis between the outer tube and the helical compression spring and axially fixed to the outer tube for external guidance along the longitudinal axis of an external guide end section of the helical compression spring opposite the internal guide end section along the longitudinal axis;

g. wherein the external guide end section of the helical compression spring is guided only by the external guide element in at least one state of motion of the inner element relative to the outer tube; and h. wherein the internal guide end section of the helical compression spring is guided only by the internal guide element in said at least one state of motion.

2. The drive device according to claim 1, wherein a. the external guide end section of the helical compression spring is guided only by the external guide element in any state of motion of the inner element relative to the outer tube; and/or b. the internal guide end section of the helical compression spring is guided only by the internal guide element in any state of motion of the inner element relative to the outer tube.

3. The drive device according to claim 1, wherein a guide element length of the external guide element and/or the internal guide element along the longitudinal axis each amount to from 40% to 80%, from 50% to 70%, or from 50% or 60%, of a spring length of the helical compression spring along the longitudinal axis in a state of the inner element retracted maximally in the outer tube along the longitudinal axis.

4. The drive device according to claim 1, wherein in a state of the inner element retracted maximally in the outer tube along the longitudinal axis, a section length of the external guide end section and/or the internal guide end section of the helical compression spring along the longitudinal axis each amounts to from 30% to 70%, from 40% to 60%, or 50%, of a spring length of the helical compression spring along the longitudinal axis.

5. The drive device according to claim 1, wherein a. the inner element is distanced from the external guide end section of the helical compression spring radially to the longitudinal axis with an internal distance in said at least one state of motion, of the inner element relative to the outer tube; and/or b. the outer tube is distanced from the internal guide end section of the helical compression spring radially to the longitudinal axis with an external distance in said at least one state of motion, of the inner element relative to the outer tube.

6. The drive device according to claim 1, wherein a. the external guide end section of the helical compression spring has an external guide clearance to the external guide element radial to the longitudinal axis in said at least one state of motion, of the inner element relative to the outer tube; and/or b. the internal guide end section of the helical compression spring has an internal guide clearance to the internal guide element radial to the longitudinal axis in said at least one state of motion, of the inner element relative to the outer tube.

7. The drive device according to claim 1, wherein a. the external guide element comprises a number of elastic compensating elements, on a side facing the outer tube for biasing against the outer tube and/or for tolerance compensation to the outer tube; and/or b. the internal guide element comprises a number of elastic compensating elements, on a side facing the inner element for biasing against the inner element and/or for tolerance compensation to the inner element.

8. The drive device according to claim 1, wherein a. the internal guide element is substantially cylindrically shaped and/or coaxially arranged to the longitudinal axis; and b. wherein the internal guide element comprises a support element, to support the internal guide end section of the helical compression spring along the longitudinal axis.

9. The drive device according to claim 1, wherein a. the external guide element is essentially hollow cylindrical shaped and/or coaxially arranged to the longitudinal axis; and b. wherein the external guide element comprises a centering element, for centering of the inner element in the external guide element.

10. The drive device according to claim 1, wherein a. the external guide element and/or the internal guide element comprises or consists of a low-friction and/or self-lubricating plastic, a polyoxymethylene, a polycarbonate, or a polytetrafluoroethylene.

11. The drive device according to claim 1, wherein the outer tube and/or the inner element comprises or consists of a metal.

12. The drive device according to claim 1, wherein a. the helical compression spring comprises or consists of a metal;

b. wherein the helical compression spring has a plastic flocking; and c. wherein the plastic flocking is impregnated.

13. The drive device according to claim 1, wherein the external guide element and/or the internal guide element has a number of recesses, radial to the longitudinal axis.

* * * * *